US011739753B1

(12) United States Patent
Yang

(10) Patent No.: US 11,739,753 B1
(45) Date of Patent: Aug. 29, 2023

(54) RADIAL COMPLIANCE MECHANISM TO URGE ORBITING MEMBER TO ANY DESIRED DIRECTION AND STAR SCROLL COMPRESSOR

(71) Applicant: Yaode Yang, Fresh Meadows, NY (US)

(72) Inventor: Yaode Yang, Fresh Meadows, NY (US)

( * ) Notice: Subject to any disclaimer, the term of this patent is extended or adjusted under 35 U.S.C. 154(b) by 0 days.

(21) Appl. No.: 17/739,236

(22) Filed: May 9, 2022

(51) Int. Cl.

| | |
|---|---|
| ***F04C 18/04*** | (2006.01) |
| ***F04C 2/06*** | (2006.01) |
| ***F04B 53/14*** | (2006.01) |
| ***F04B 49/12*** | (2006.01) |
| ***F04C 28/22*** | (2006.01) |

(52) U.S. Cl.
CPC ..... *F04C 18/04* (2013.01); *F04B 49/125* (2013.01); *F04B 53/14* (2013.01); *F04C 2/06* (2013.01); *F04C 28/22* (2013.01)

(58) Field of Classification Search
CPC ..... F04C 2/025; F04C 2/04; F04C 18/0207–0292; F04C 18/04; F04C 14/18–226; F04C 28/18–22; F01C 1/0207–0292; F01C 1/04; F01C 20/18–22; F01C 2021/1606–1637
See application file for complete search history.

(56) References Cited

U.S. PATENT DOCUMENTS

| | | | | |
|---|---|---|---|---|
| 6,099,279 A * | 8/2000 | Kohsokabe | ..... | F04C 18/04 418/61.1 |
| 6,152,714 A * | 11/2000 | Mitsuya | ..... | F01C 17/066 418/61.1 |
| 6,179,593 B1 * | 1/2001 | Mitsuya | ..... | F04C 18/04 418/94 |
| 2001/0008610 A1 * | 7/2001 | Kouno | ..... | F04C 18/04 418/61.1 |

FOREIGN PATENT DOCUMENTS

| | | | | |
|---|---|---|---|---|
| DE | 102004001817 A1 * | 8/2005 | ..... | F04C 14/22 |
| KR | 950025267 A * | 9/1995 | | |
| WO | WO-9408140 A1 * | 4/1994 | ..... | F04C 18/04 |

* cited by examiner

*Primary Examiner* — Laert Dounis
(74) *Attorney, Agent, or Firm* — IPRO, PLLC

(57) ABSTRACT

Described herein is a mechanism including: a driving shaft comprising an eccentric crank and an arm part extending radially from the driving shaft, the arm part of the driving shaft comprising a piston housing; a piston in the piston housing; an eccentric lever bushing comprising an arm part extending radially therefrom, a cylindrical outer surface and a cylindrical hole, wherein the cylindrical hole is rotatably attached to the eccentric crank, wherein an axis of the cylindrical hole and an axis of the cylindrical outer surface are parallel and offset; wherein the piston is configured to apply a torque on the eccentric lever bushing by pushing the arm part of the eccentric lever bushing. The driving shaft may further comprise a channel configured to apply fluid pressure on the piston. This mechanism may be used in a device such as a star scroll compressor.

18 Claims, 7 Drawing Sheets

RADIAL COMPLIANCE MECHANISM TO URGE ORBITING MEMBER TO ANY DESIRED DIRECTION AND STAR SCROLL COMPRESSOR

BACKGROUND

A scroll compressor comprises a fixed member with one or plural revolute scrolls, and an orbiting member with the same number of revolute scrolls. The orbiting member orbits along a circular path relative to the fixed member and forms enclosed spaces between the fixed member and the orbiting member to compress fluid in the enclosed spaces. Most scroll compressors need an anti-rotation device to maintain a constant angular offset between the fixed member and the orbiting member during the orbiting motion.

Radial compliance is an approach utilized to minimize the radial clearance between the fixed member and the orbiting member, also to provide relief of high pressure during liquid ingestion.

An eccentric bushing radial compliance utilizes an eccentric lever bushing fit between a driving shaft and a rotor hub of a rotor. Radial compliance is accomplished by allowing the eccentric bushing to rotate relative to the driving shaft so the rotor hub can move radially relative to the driving shaft and a housing of the rotor. The eccentric bushing rotating angle relative to the driving shaft is limited by the load direction on the rotor.

SUMMARY

Disclosed herein is a mechanism comprising: a driving shaft comprising an eccentric crank and an arm part extending radially from the driving shaft, the arm part of the driving shaft comprising a piston housing; a piston in the piston housing; an eccentric lever bushing comprising an arm part extending radially therefrom, a cylindrical outer surface and a cylindrical hole. The cylindrical hole is rotatably attached to the eccentric crank. An axis of the cylindrical hole and an axis of the cylindrical outer surface are parallel and offset. The piston is configured to apply a torque on the eccentric lever bushing by pushing the arm part of the eccentric lever bushing.

In an aspect, the driving shaft further comprises a channel configured to apply fluid pressure on the piston.

In an aspect, the mechanism further comprises a valve configured to adjust flow of lubricant from the channel.

In an aspect, the piston is configured to moving tangentially with respect to the driving shaft.

In an aspect, the mechanism further comprises a spring urging the piston away from the piston housing.

In an aspect, the mechanism further comprises a sliding seal between the piston and the piston housing.

In an aspect, the driving shaft further comprises a main shaft eccentric from the eccentric crank.

In an aspect, a principal axis of inertia of the driving shaft is a geometric axis of the main shaft. Namely, the arm part of the eccentric lever bushing, the arm part of the driving shaft and the piston function as counterweights to the eccentric crank.

Also disclosed herein is a device comprising: a fixed member comprising an inner surface, wherein the inner surface encloses a chamber with a plurality of scroll lobes extended into the chamber; an orbiting member comprising an outer surface enclosing a main body, and the main body having a plurality of scroll lobes extending outward and in the chamber; wherein the orbiting member is configured to orbit along a circular path relative to the fixed member; wherein the orbiting member and the fixed member have a same number of scroll lobes and form a same number of working scroll pairs; wherein the orbiting member and the fixed member form fluid-tight enclosed spaces between the orbiting member and the fixed member; wherein the orbiting member and the fixed member are engaged during orbiting of the orbiting member; wherein the scroll lobes are configured such that the orbiting member is at a side of parting from the fixed member by the compression torque at starting of contact between each of the working scroll pairs during orbiting of the orbiting member; a discharge plate attached to an end of the fixed member; a suction plate attached to another end of the fixed member; wherein the suction plate comprises suction holes through the suction plate, and the suction holes are configured to be fluidly connected to the enclosed spaces; wherein the discharge plate comprises discharge holes through the discharge plate, and the discharge holes are configured to be fluidly connected to the enclosed spaces; wherein the orbiting member has a bearing hole concentric with its geometric center axis.

In an aspect, the orbiting member slides through plural tangential contact lines with the fixed member.

In an aspect, the orbiting member and the fixed member form fluid-tight enclosed spaces through the plural contact lines.

In an aspect, the orbiting member and the fixed member are engaged through the plural contact lines.

In an aspect, the enclosed spaces form, disappear, and change volume during the orbiting to compress fluid inside or suck fluid outside; the scroll lobes of the fixed member, the scroll lobes of the orbiting member, and the enclosed spaces are rotationally symmetric around a center in a star pattern.

In an aspect, the device further comprises check valves covering the discharge holes.

In an aspect, the inner surface of the fixed member comprises segments of arcuate surfaces, each of the segments of arcuate surfaces being tangent with its immediate neighboring segments; wherein the outer surface of the orbiting member comprises segments of arcuate surfaces, each of the segments of arcuate surfaces being tangent with its immediate neighboring segments.

In an aspect, the device further comprises any of the mechanisms above.

DETAILED DESCRIPTION

Figure 1A:
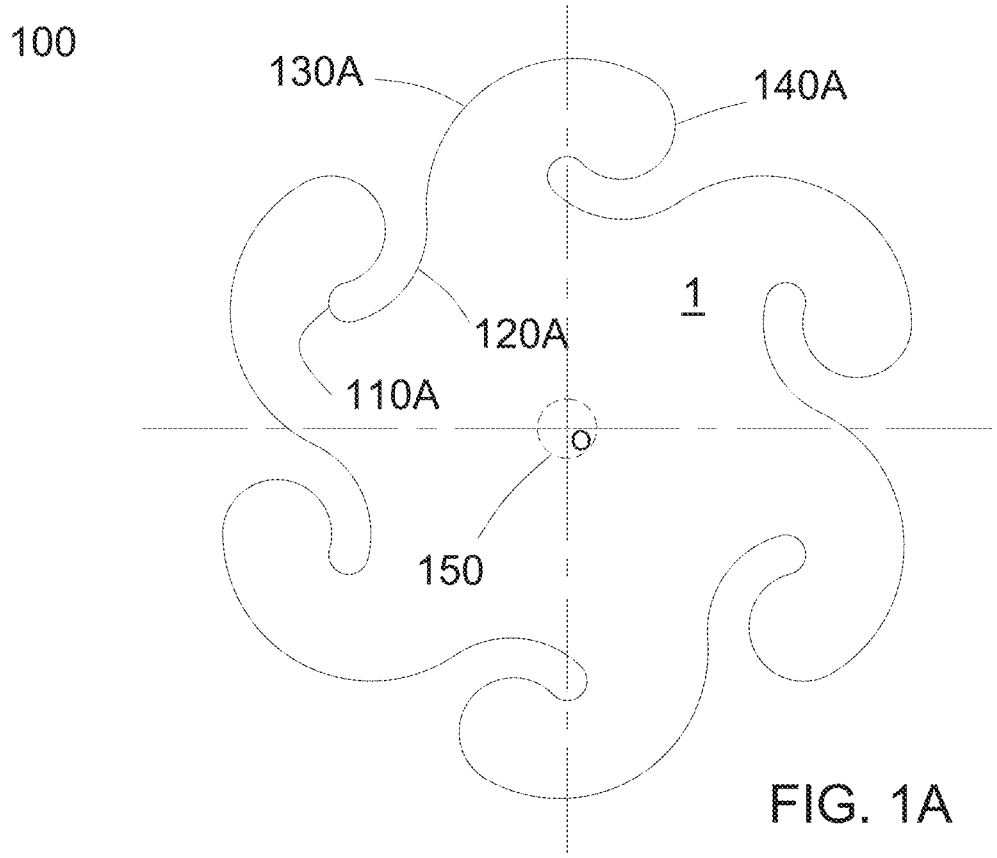
FIG. 1A and FIG. 1B respectively show an end view of the inner surface of the fixed member of a scroll compressor and an end view of the outer surface of the orbiting member of the scroll compressor.

A device as described herein comprises a fixed member having an inner surface, the inner surface enclosing a lobed chamber with plural revolute scrolls (also called scroll lobes) extend into the lobed chamber. The scroll lobes extending into the lobed chamber are rotationally symmetric around a center. In an example, the inner surface comprises segments of arcuate surfaces, each of the segments of arcuate surfaces being tangent with its immediate neighboring segments. Two arcuate surfaces "being tangent" as used herein means that the angles between the two arcuate surfaces are zero at an intersecting line between the two arcuate surfaces. The device also comprises an orbiting member located inside the lobed chamber. The orbiting member has plural scroll lobes extend outward. The scroll lobes of the orbiting member are rotationally symmetric around a center. In an example, the outer surface of the orbiting member comprises segments of arcuate surfaces, each of the segments of arcuate surfaces being tangent with its immediate neighboring segments. The outer surface of the orbiting member encloses a main body of the orbiting member.

The orbiting member is configured to orbit along a circular path relative to the fixed member. The orbiting member further comprises a cylinder hole in its center. Preferably, the orbiting member orbits along a circular path that is concentric with a rotational symmetric center of the fixed member. Preferably, the orbiting member does not rotate relative to the fixed member during orbiting. The orbiting member slides through plural tangential contact lines with the fixed member during orbiting. The outer surface of the orbiting member and the inner surface of the fixed member are engaged by the tangential contact lines. The orbiting member and the fixed member form fluid-tight contact at the tangential contact lines, thereby forming fluid-tight enclosed spaces between the fixed member and the orbiting member. As explained in more details below, the enclosed spaces change volume during orbiting.

Due to limitations of machining, the shape of the scroll lobes may not be perfect, and the circular path may not be perfectly circular. Therefore, the orbiting member may knock the fixed member at starting of contact of each working scroll pair. The scroll lobes may be configured such that the orbiting member is at the side of parting from the fixed member by a compression torque at starting of contact between each working scroll pair during its orbiting.

The device may further comprise a discharge plate attached to an end of the fixed member. The discharge plate further comprises discharge holes through the discharge plate and the discharge holes can be fluidly connected to the enclosed spaces during orbiting of the orbiting member.

The device may further comprise check valves (e.g., reed valves) covering the discharge holes of discharge plate to allow compressed fluid in the enclosed spaces to egress and to prevent ingress of fluid into the enclosed spaces through the discharge holes.

The device may further comprise check valve stoppers attached to the check valves to prevent the reeds of the check valves from opening too much to protect the check valves from being deformed or damaged.

The device may further comprise a suction plate attached to another end of the fixed member. The suction plate comprises suction holes through the suction plate and the suction holes can be fluidly connected to the enclosed spaces during orbiting of the orbiting member.

The device may further comprise a driving shaft with an eccentric crank. The driving shaft may further comprise an arm part with a piston housing. The driving shaft may further comprise a fluid channel inside to connect a fluid source.

The device may further comprise an eccentric lever bushing with an arm part. The eccentric lever bushing may further comprise a cylindrical hole surface rotatably attached to the eccentric crank of the driving shaft. The eccentric lever bushing may further comprise an outside cylinder surface rotatably attached to the cylinder hole of the orbiting member. The eccentric lever bushing can rotate relative to the crank and the orbiting member. The axis of the outside cylinder surface and the axis of the cylindrical hole surface are parallel and offset.

The device may further comprise a piston in the piston housing of the arm part of the driving shaft and slidingly attached to the arm part of the eccentric lever bushing.

The arm part of the eccentric lever bushing, the arm part of the driving shaft and the piston may function as counterweights.

Fluid pressure at the inside of the piston housing of the arm part of the driving shaft pushes the piston and the arm part of the eccentric lever bushing and produces a torque on the eccentric lever bushing. The torque produces a force through the outside cylinder surface of the eccentric lever bushing to the cylinder hole of the orbiting member to push the orbiting member against the fixed member radially.

If the pressure of the fluid in an enclosed space during compression is higher than normal, for example with too much fluid in the enclosed space, the pressure can produce a higher torque through the orbiting member on the eccentric lever bushing. The higher torque produces a higher force between the arm part of the eccentric lever bushing and the piston to push the piston back, which allows the orbiting member to be displaced to increase the volume of the enclosed space to reduce the pressure inside.

Discharged high pressure from the enclosed space can be used to drive lubricant into the channel inside driving shaft and through a lubricant flow valve 3G (see FIG. 4) to the low pressure side and flow into to spaces between orbiting member, the fixed member, driving shaft, and eccentric lever bushing to reduce friction and form fluid-tight seals.

Figure 1B:
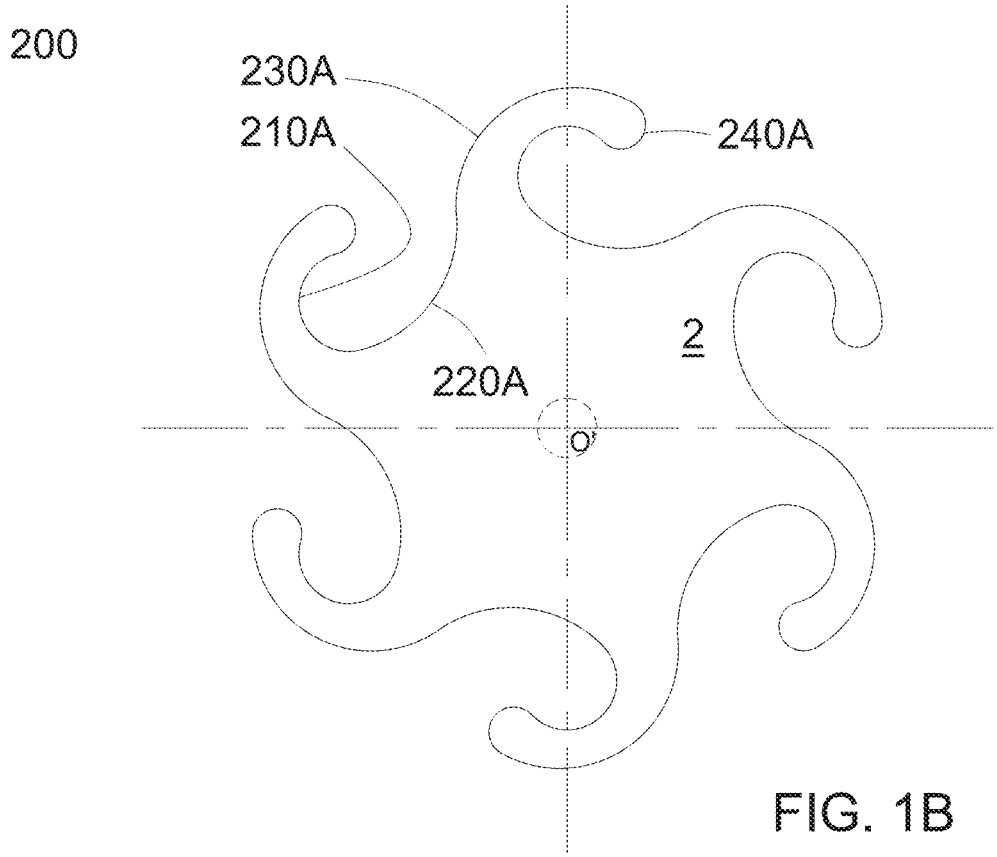

FIG. 1A shows an end view of the inner surface 100 of the fixed member 1 and FIG. 1B shows an end view of the outer surface 200 of the orbiting member 2. The inner surface 100 has copies of 4 segments of arcuate surfaces: 110A, 120A, 130A, 140A. The inner surface 100 has n-fold rotational symmetry with a point O as the rotational symmetric center, wherein n can be any integer greater than one, such as six. Each segment of arcuate surface of the inner surface 100 is tangent to its neighboring segments. The outer surface 200 has copies of 4 segments of arcuate surfaces: 210A, 220A, 230A, 240A. The outer surface 200 has n'-fold rotational symmetry with a point O' as the rotational symmetric center, wherein n' can be any integer greater than one and preferably equals n. Each segment of the outer surface 200 is tangent to its neighboring segments. The orbiting member 2 orbits along a circular path 150 concentric with the point O.

FIGS. 2A-2F show locations of the orbiting member 2 relative to the inner surface 100 of the fixed member 1, at six orbiting positions as the orbiting member 2 orbits along the circular path 150, according to an embodiment. Enclosed spaces, such as enclosed spaces 203 and 204, form between the scroll lobes of the orbiting member 2 and the scroll lobes of the fixed member 1, when the orbiting member 2 is at certain orbiting positions.

Figure 2A:
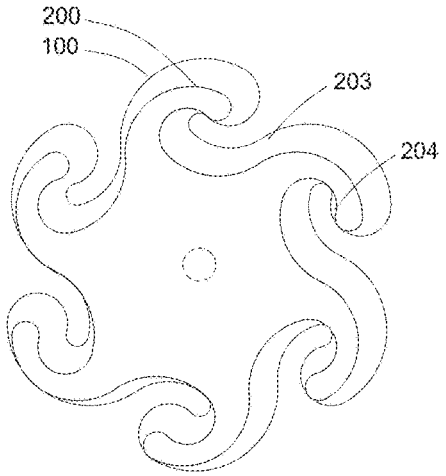
FIG. 2A through FIG. 2F show end views the inner surface of the fixed member and outer surface of the orbiting member at six orbiting positions in one orbiting cycle of the orbiting member.
Figure 2B:
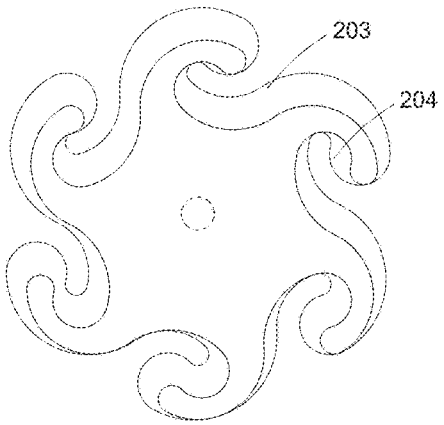
Figure 2C:
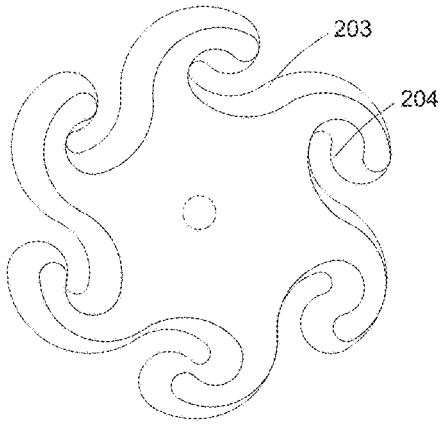
Figure 2D:
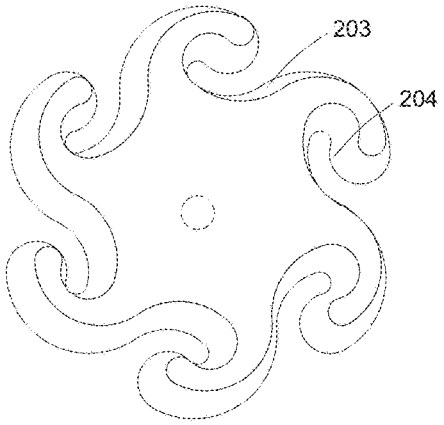
Figure 2E:
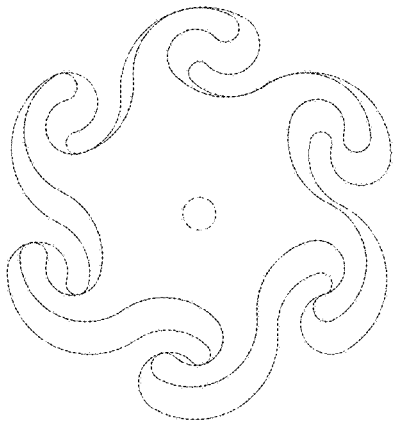
Figure 2F:
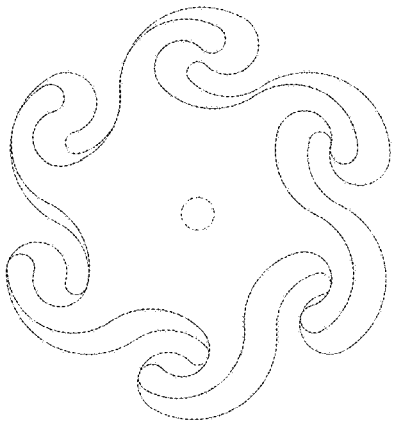
Figure 3A:
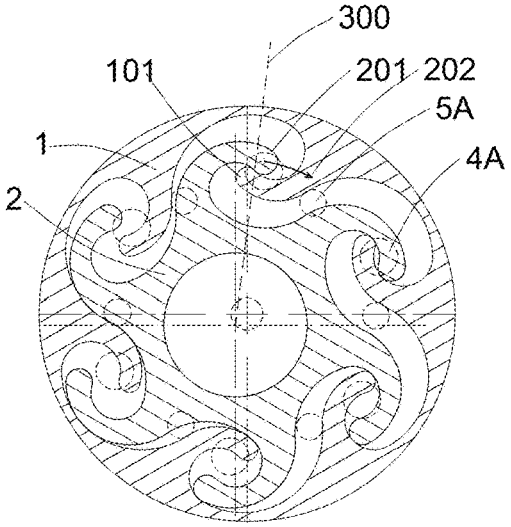
FIG. 3A through FIG. 3F show end views of the fixed member, the orbiting member, a suction plate and suction holes therein, a discharge plate and discharge holes therein at the six orbiting positions.
Figure 3B:
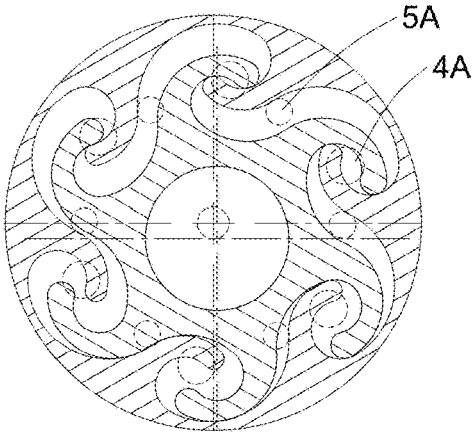
Figure 3C:
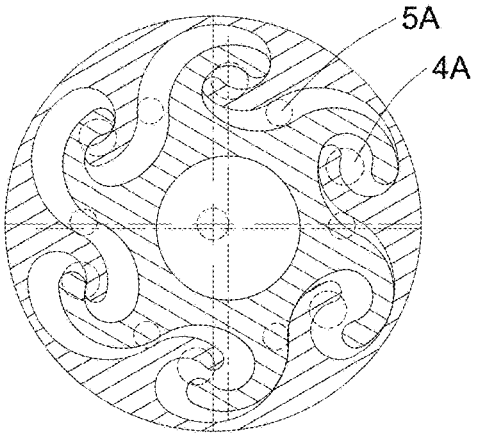
Figure 3D:
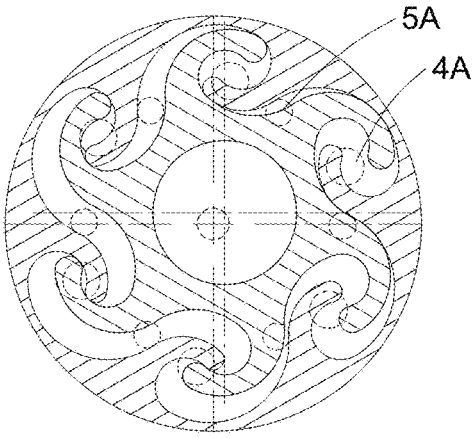
Figure 3E:
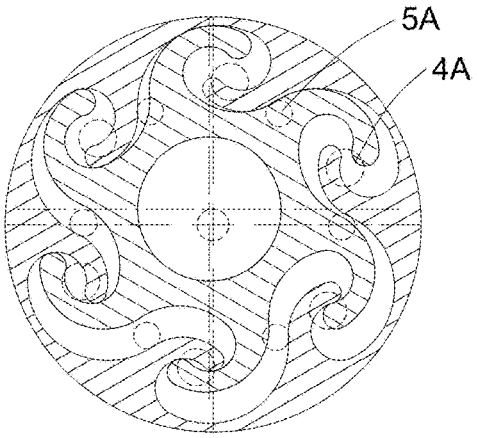
Figure 3F:
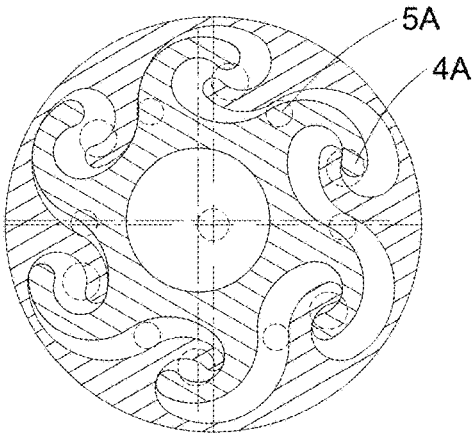

Volume of the enclosed spaces 203 and 204 change as the orbiting member 2 orbits along the circular path 150 relative to the fixed member 1. In this particular example, as the orbiting member 2 orbits along the circular path 150 counterclockwise, the enclosed space 203 periodically forms, contracts and disappears (i.e., connected to space between another pair of scroll lobes of the fixed member 1 and the orbiting member 2, such as shown in FIGS. 2E and 2F); the enclosed space 204 periodically forms, expands and disappears (i.e., connected to space between another pair of scroll lobes of the fixed member 1 and the orbiting member 2, such as shown in FIGS. 2E and 2F). The enclosed space 203 can be used as a compression chamber to compress and/or increase pressure of fluid therein. The enclosed space 204 can be used as an intake chamber to draw fluid to be compressed.

FIG. 3A through FIG. 3F show end views of the fixed member, the orbiting member, a suction plate and suction holes therein, a discharge plate and discharge holes therein at the six orbiting positions. The high pressure inside compression chamber produces a torque to rotate the orbiting member 2 clockwise as shown as direction 202 about its center axis. The line 300 crosses through the center axis of the orbiting member 2 and the starting contact point. When the working scroll pair on top of FIG. 3A starts to contact, a scroll tip 201 of the orbiting member 2 at the right side of line 300 tends to move rightward to enlarge the distance to, namely part from a scroll tip 101 of the fixed member 1 to avoid knocking of the orbiting member 2 and the fixed member 1.

Figure 4:
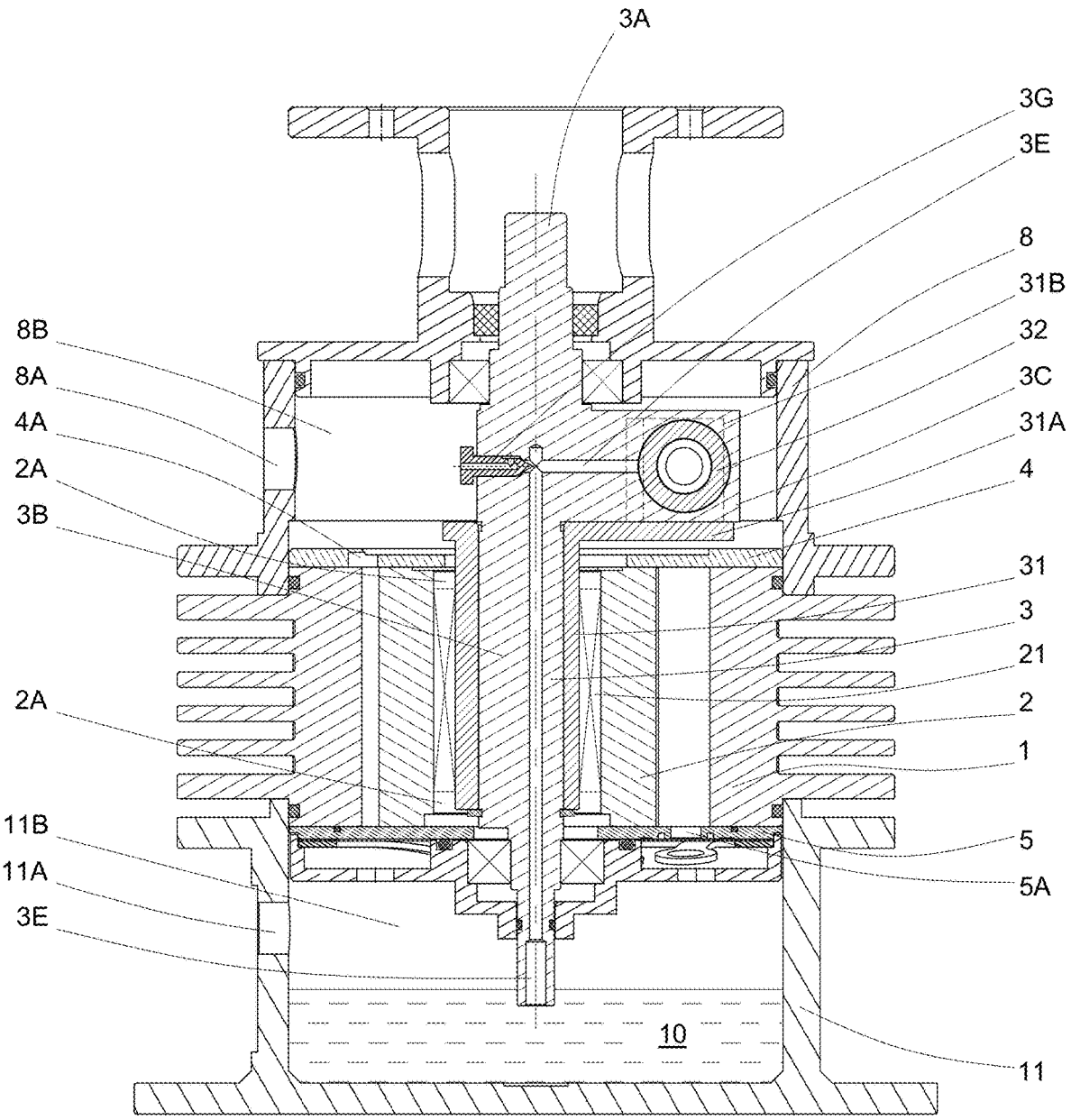
FIG. 4 shows a vertical section view of the scroll compressor.

FIG. 4 is a cross-sectional view of a scroll compressor according to an embodiment. In this embodiment, the orbiting member 2 is enclosed by the fixed member 1, the suction plate 4, and the discharge plate 5. The height of the orbiting member 2 is slightly smaller than the distance between the suction plate 4 and the discharge plate 5 to allow the orbiting member 2 move inside freely and seal the two ends of the orbiting member 2 with lubricant. The orbiting member 2 also comprises a bearing hole 2A concentric to the symmetry center of the orbiting member 2 and open from both ends.

The driving shaft 3 comprises a main shaft 3A for coupling to a mechanical power input. The driving shaft 3 further comprises the eccentric crank 3B to the main shaft. The driving shaft 3 further comprises the arm part 3C. The arm part 3C further comprises the piston housing 3D (see FIG. 6). The driving shaft 3 further comprises the fluid channel 3E opened at one end and fluidly connected to the higher pressure discharged fluid. The fluid channel 3E further fluidly connects a discharged high pressure fluid space 11B to the inside of the piston housing 3D.

The eccentric lever bushing 31 comprises the cylindrical outer surface rotatably attached to the cylinder hole of the orbiting member 2 through bearing 21, and the eccentric lever bushing 31 further comprises a cylindrical hole surface rotatably attached to the eccentric crank 3B. The axis of the cylindrical outer surface and the axis of the cylindrical hole surface are parallel and offset.

The piston 32 located inside the piston housing 3D is configured to use the fluid pressure inside the piston housing 3D to push the arm part 31A of the eccentric lever bushing 31. There may be a sliding seal 38 between the piston 32 and the piston housing 3D.

The arm part 3A of the driving shaft 3, the arm part 31A of the eccentric lever bushing 31 and the piston 32 also work as counterweights to counter centrifugal force caused by orbiting of the orbiting member 2, which is eccentric relative to the main shaft 3A, and to reduce vibration. Namely, the arm part 3A of the driving shaft 3, the arm part 31A of the eccentric lever bushing 31 and the piston 32 are configured such that a principal axis of inertia of the driving shaft 3 is a geometric axis of the main shaft.

Low pressure fluid flows through an inlet 8A into an upper chamber 8B inside a fluid suction shell 8, and through the suction hole 4A of the suction plate 4 into the lobed chamber of fixed member 1. Compressed fluid discharged from the lobed chamber flows through the discharge hole 5A of the discharge plate 5, into the space inside an output fluid shell 11. The fluid finally flows out through an outlet 11A of the output fluid shell 11.

As shown in FIG. 4, lubricant 10 flows into the channel 3E under pressure discharged from the enclosed space. The flow of the lubricant 10 is adjusted through the lubricant flow valve 3G, and flows into the space of the low pressure side (i.e., the upper chamber 8B), where it flows into the spaces between the moving parts for lubrication, and flows with compressed fluid into the output fluid shell 11.

Figure 5:
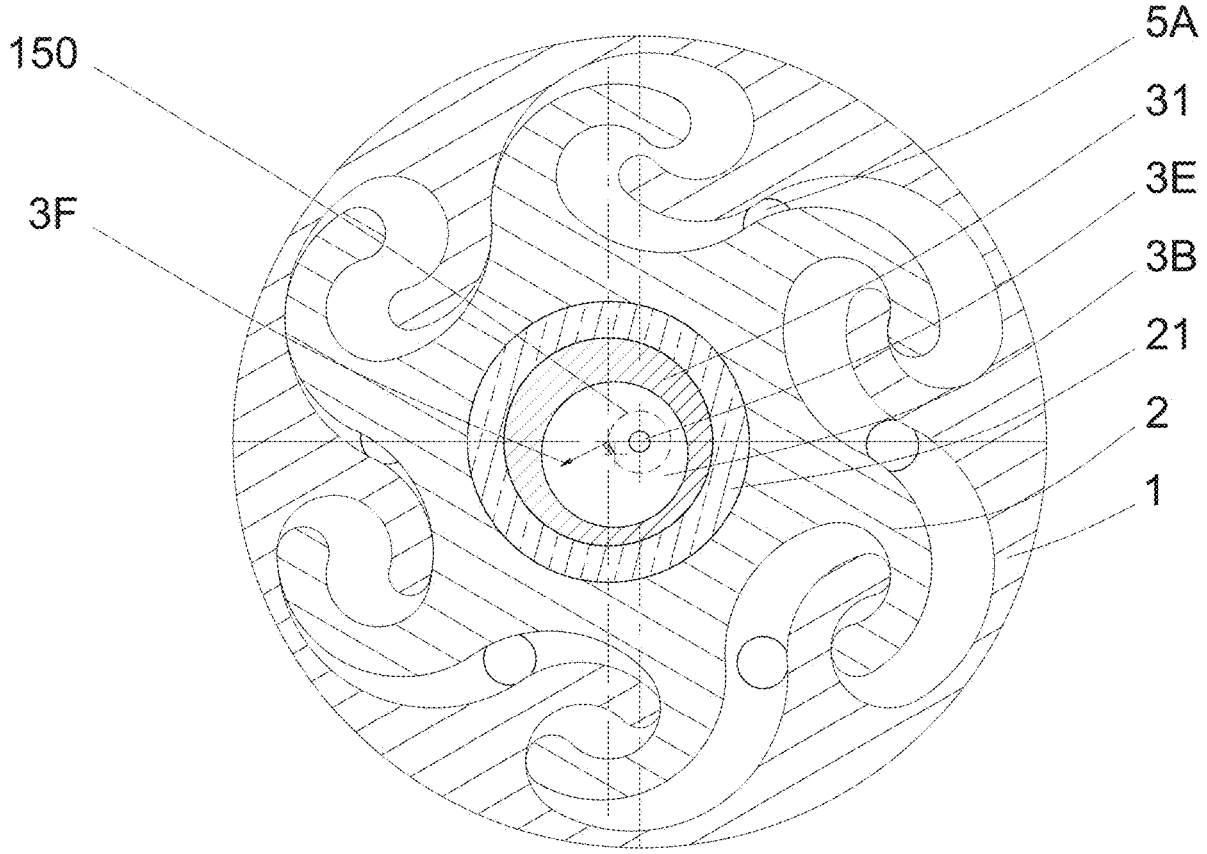
FIG. 5 shows an end view of the driving shaft, the orbiting member, and the eccentric lever bushing of the scroll compressor.

FIG. 5 shows an end view of the fixed member 1, the orbiting member 2, the eccentric crank 3B, the eccentric lever bushing 31, and the bearing 21 between the eccentric lever bushing 31 and the orbiting member 2. The center of the orbiting member 2 and the center of the outer surface of eccentric lever bushing 31 are concentric and move along the path 150.

Due to limitations of machining, the shape of the scroll lobes may not be perfect, and the path 150 may not be perfectly circular. This consequently cause leaking gaps between the fixed member 1 and the orbiting member 2 during compression, thereby causing leakage of the enclosed spaces. The high pressure fluid in the enclosed spaces during compression may leak from the gaps.

Figure 6:
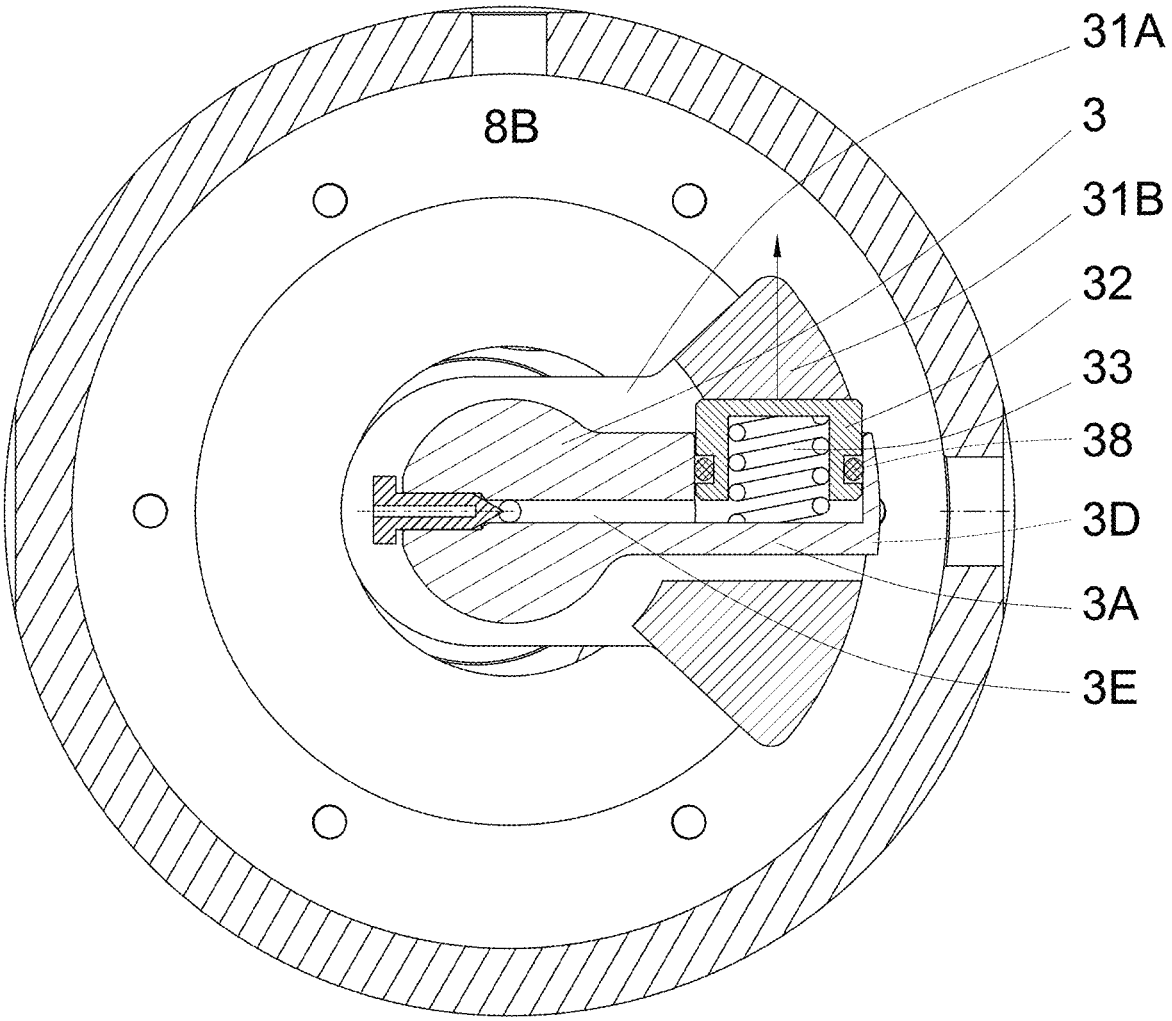
FIG. 6 shows an end view of the driving shaft, the fluid channel, the piston and the eccentric lever bushing.
Figure 7A:
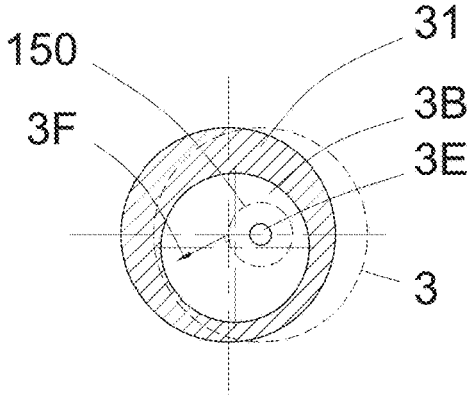
FIG. 7A through FIG. 7F are views showing relative positions between the eccentric lever bushing and the driving shaft to set six different directions of pushing force towards the orbiting member.
Figure 7B:
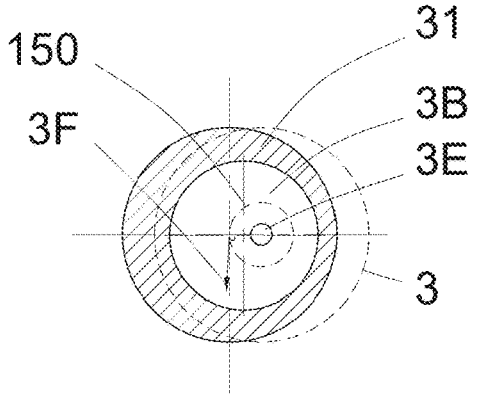
Figure 7C:
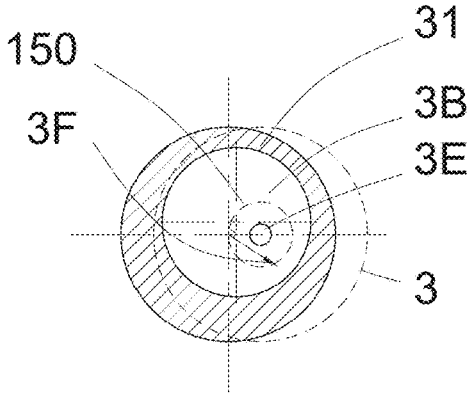
Figure 7D:
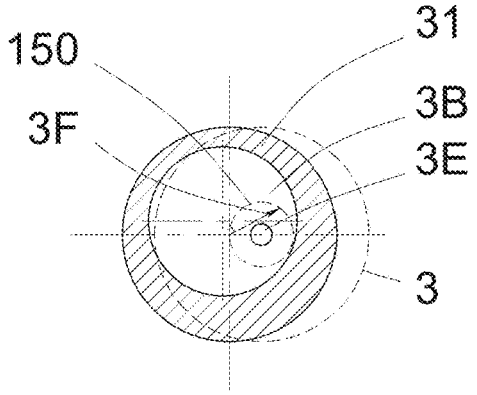
Figure 7E:
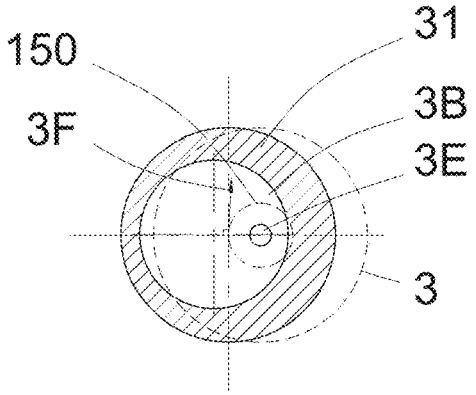
Figure 7F:
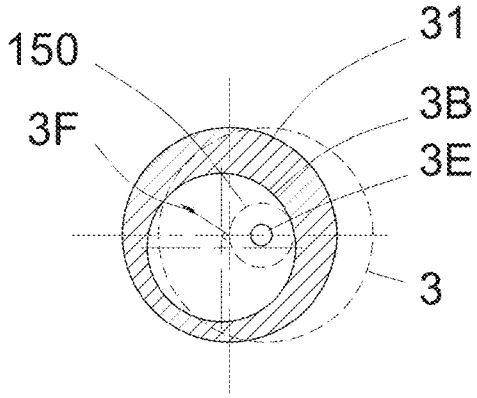

FIG. 6 shows an end view of the arm part 3A of the driving shaft 3, the piston 32, and a boss part 31B on the arm part 31A of the eccentric lever bushing 31. The fluid inside the piston housing 3D is fluidly connected to the discharged high pressure fluid space 11B and thus has a higher pressure than the fluid inside the upper chamber 8B. This pressure differential produces a force (as represented by the arrow) that pushes the piston 32 toward the outside of the piston housing 3D. The piston 32 pushes the boss part 31B and produces a torque on the eccentric lever bushing 31 through the arm part 31A.

The torque causes the eccentric lever bushing 31 to rotate counterclockwise about the eccentric crank 3B, in the views of FIG. 5 and FIG. 6, forces the center of the outer surface of the eccentric lever bushing 31 and the center of the orbiting member 2 to move away along a direction 3F from the path 150, thereby pushing the orbiting member 2 against the fixed member 1 so as to reduce the leaking gaps between the orbiting member 2 and the fixed member 1 during compression.

If there is too much fluid, as especially if the fluid is a liquid, inside an enclosed space, the pressure in the enclosed space increases substantially at the end of the compression. This high pressure pushes the orbiting member 2 along the opposite of the direction 3F thereby increasing the gaps of compression chamber to release the high pressure inside the enclosed space to protect the scroll compressor. This high pressure also causes the eccentric lever bushing 31 to rotate clockwise about the eccentric crank 3B (in the views of FIG.

5 and FIG. 6) and the boss part 31B causes the piston 32 to move into the piston housing 3D.

A spring 33 provides a force towards the eccentric lever bushing 31 to keep the orbiting member 2 orbiting on the path 150 at the beginning of the operation when high pressure in the enclosed space has not been established.

FIG. 7A through 7F are views showing the relative positions between the eccentric lever bushing 31 and the eccentric crank 3B at the same orbiting position of the orbiting member 2. By adjusting the position of the eccentric lever bushing 31 relative to the eccentric crank 3B, the direction 3F can be adjusted.

In relation to the claims, it is intended that when words such as "a," "an," "at least one," or "at least one portion" are used to preface a feature there is no intention to limit the claim to only one such feature unless specifically stated to the contrary in the claim.

The descriptions above are intended to be illustrative, not limiting. Thus, it will be apparent to one skilled in the art that modifications may be made without departing from the scope of the claims set out below.

What is claimed is:

1. A mechanism comprising:

a driving shaft comprising an eccentric crank and an arm part extending radially from the driving shaft, the arm part of the driving shaft comprising a piston housing;

a piston in the piston housing;

an eccentric lever bushing comprising an arm part extending radially therefrom, a cylindrical outer surface and a cylindrical hole, wherein the cylindrical hole is rotatably attached to the eccentric crank, wherein an axis of the cylindrical hole and an axis of the cylindrical outer surface are parallel and offset;

wherein the piston is configured to apply a torque on the eccentric lever bushing by pushing the arm part of the eccentric lever bushing.

2. The mechanism of claim 1, wherein the driving shaft further comprises a channel configured to apply fluid pressure on the piston.

3. The mechanism of claim 2, further comprising a valve configured to adjust flow of lubricant from the channel.

4. The mechanism of claim 1, wherein the piston is configured to moving tangentially with respect to the driving shaft.

5. The mechanism of claim 1, further comprising a spring urging the piston away from the piston housing.

6. The mechanism of claim 1, further comprising a sliding seal between the piston and the piston housing.

7. The mechanism of claim 1, wherein the driving shaft further comprises a main shaft eccentric from the eccentric crank.

8. The mechanism of claim 7, wherein a principal axis of inertia of the driving shaft is a geometric axis of the main shaft.

9. A device comprising:

a fixed member comprising an inner surface, wherein the inner surface encloses a chamber with a plurality of scroll lobes extended into the chamber;

an orbiting member comprising an outer surface enclosing a main body, and the main body having a plurality of scroll lobes extending outward and in the chamber;

wherein the orbiting member is configured to orbit along a circular path relative to the fixed member;

wherein the orbiting member and the fixed member have a same number of scroll lobes and form a same number of working scroll pairs;

wherein the orbiting member and the fixed member form fluid-tight enclosed spaces between the orbiting member and the fixed member;

wherein the orbiting member and the fixed member are engaged during orbiting of the orbiting member;

wherein the scroll lobes are configured such that a compression torque at starting of contact between each of the working scroll pairs during orbiting of the orbiting member causes each of the working scroll pairs to part;

a discharge plate attached to an end of the fixed member;

a suction plate attached to another end of the fixed member;

wherein the suction plate comprises suction holes through the suction plate, and the suction holes are configured to be fluidly connected to the enclosed spaces;

wherein the discharge plate comprises discharge holes through the discharge plate, and the discharge holes are configured to be fluidly connected to the enclosed spaces;

wherein the orbiting member has a bearing hole concentric with its geometric center axis;

wherein the device further comprises a mechanism that comprises:

a driving shaft comprising an eccentric crank and an arm part extending radially from the driving shaft, the arm part of the driving shaft comprising a piston housing;

a piston in the piston housing;

an eccentric lever bushing comprising an arm part extending radially therefrom, a cylindrical outer surface and a cylindrical hole, wherein the cylindrical hole is rotatably attached to the eccentric crank, wherein an axis of the cylindrical hole and an axis of the cylindrical outer surface are parallel and offset;

wherein the piston is configured to apply a torque on the eccentric lever bushing by pushing the arm part of the eccentric lever bushing.

10. The device of claim 9, further comprising check valves covering the discharge holes.

11. The device of claim 9, wherein the inner surface of the fixed member comprises segments of arcuate surfaces, each of the segments of arcuate surfaces being tangent with its immediate neighboring segments; wherein the outer surface of the orbiting member comprises segments of arcuate surfaces, each of the segments of arcuate surfaces being tangent with its immediate neighboring segments.

12. The device of claim 9, wherein the driving shaft further comprises a channel configured to apply fluid pressure on the piston.

13. The device of claim 12, wherein the mechanism further comprises a valve configured to adjust flow of lubricant from the channel.

14. The device of claim 9, wherein the piston is configured to moving tangentially with respect to the driving shaft.

15. The device of claim 9, wherein the mechanism further comprises a spring urging the piston away from the piston housing.

16. The device of claim 9, wherein the mechanism further comprises a sliding seal between the piston and the piston housing.

17. The device of claim 9, wherein the driving shaft further comprises a main shaft eccentric from the eccentric crank.

18. The device of claim 17, wherein a principal axis of inertia of the driving shaft is a geometric axis of the main shaft.

* * * * *